US005970531A

United States Patent [19]

Demby

[11] Patent Number: 5,970,531

[45] Date of Patent: Oct. 26, 1999

[54] PORTABLE, MODULAR, WOODEN, POOL COVER FRAME

[75] Inventor: Clayton C. Demby, 1 Layfayette St., Wharton, N.J. 07885

[73] Assignee: Clayton C. Demby, Wharton, N.J.

[21] Appl. No.: 09/170,966

[22] Filed: Oct. 13, 1998

[51] Int. Cl.[6] ..... E04H 4/06

[52] U.S. Cl. ..... 4/498; 4/503; 52/66; 52/643

[58] Field of Search ..... 4/494, 498, 503, 4/496; 52/66, 67, 90.1, 643

[56] References Cited

U.S. PATENT DOCUMENTS

| | | | |
|---|---|---|---|
| 2,541,784 | 2/1951 | Shannon | 52/643 |
| 2,603,171 | 7/1952 | Smith | 52/66 |
| 3,469,587 | 9/1969 | Folkes | 4/498 |
| 3,534,412 | 10/1970 | Cook | 4/172.12 |
| 3,855,643 | 12/1974 | Sanford et al. | 4/498 |
| 4,000,527 | 1/1977 | Gannon | 4/172.12 |
| 4,051,638 | 10/1977 | Heintz | 52/63 |
| 4,092,809 | 6/1978 | Bellas et al. | 52/63 |
| 4,426,744 | 1/1984 | Love | 4/503 |
| 4,429,425 | 2/1984 | Weir et al. | 4/503 |
| 4,683,686 | 8/1987 | Ozdemir | 52/64 |
| 5,303,527 | 4/1994 | Perez et al. | 52/632 |
| 5,327,691 | 7/1994 | Eryou | 52/66 |
| 5,426,899 | 6/1995 | Jones | 52/63 |

*Primary Examiner*—Charles R. Eloshway

[57] ABSTRACT

A modular, wooden, pool cover frame, designed to replace conventional floating supports with a frame that spans the area above the pool, providing rigid support that is not susceptible to the problems such as puncture, rupture, structural integrity failure or water sitting on the pool cover. An A-frame like wooden structure covers the entire pool area. The frame is modular in design and has a plurality of locking wheel assemblies on the bottom thereof making it easy to store and set up, even by a single person. Depending upon the size and shape of the pool, a number of vertically aligned, equally spaced A-frame assemblies are placed spanning across the pool and are connected to one another by multiple support beams. Additional support arms are angled from the A-frame components to the ground in order to provide additional support. With the pool cover placed over the frame, a tent-like shape results that allows debris and water to run off the pool cover.

6 Claims, 4 Drawing Sheets

PORTABLE, MODULAR, WOODEN, POOL COVER FRAME

RELATED APPLICATIONS

The present invention was first described in Disclosure Document 433089 filed on Mar. 3, 1998.

BACKGROUND OF THE INVENTION

1. Field of the Invention

The present invention relates generally to pool covering devices, and, more particularly, to a modular, wooden, pool cover frame.

2. Description of the Related Art

Pool owners who live in areas that require that they leave the pools covered during the winter months know all too well of the burdens and hassles associated with pool cover maintenance. Typically, these covers are anchored around the pool perimeter and supported in the pool itself by balloon-like floats. The floating supports tend to either deflate or move about resulting in sagging portions that collect leaves, branches and water. As a result, the pool owner must constantly adjust the cover, reposition and inflate the floats, and tighten the perimeter anchoring. Furthermore, the cover can become damaged and torn due to the excessive stress created by the collected water and debris. Ultimately, the cover needs to be replaced prematurely and at a considerable cost. Accordingly, the need has developed for a pool covering method that solves the problems associated with conventional float-type support methods.

In the related art, several patents disclose improved support mechanisms for swimming pool covers including floatation devices, in-pool support devices and support frames that span the area above the pool.

U.S. Pat. No. 5,303,527, issued in the name of Perez et al., discloses a removable support apparatus for supporting a swimming pool cover. The apparatus consists of a plurality of elongated adjustable frame assemblies. Each adjustable frame assembly includes a pair of elongated frame members which are longitudinally displacable relative to each other to adjust the overall length of the frame assembly in order that the frame assembly can fit across the pool. The removable support apparatus includes an elongated hollow tubular post with a column member which is capable of telescopic movement. The column member's pivotal base pad sits on the bottom of the pool underlying one of the frame assemblies so as to support such frame assembly. The column member can be adjusted to a desired height. This device is limited to in-ground pools and requires installing at least one telescoping column member in an upright standing position on the floor of the pool to support the frame assembly. Furthermore, the capability for debris and water run off, if any, is minimum at most.

U.S. Pat. No. 4,429,425, issued in the name of Weir et al., discloses a locking retaining bead being fixed to and holding a swimming pool cover or dome. The retaining bead of the invention, which is secured to the peripheral edge of the cover, consists of an elongated hook-like cross section which can be horizontally inserted into a channel or groove. The retaining bead is preferably formed of a semi-rigid plastic. The channel or groove is provided with at least one vertical retaining lip in order to enhance the retaining power of the bead. Dislodgement of the bead, it being attached or secured to the pool cover, is prevented when such pool cover is elongated horizontally and the bead meets with the retaining lip and becomes wedged. Another retaining lip could serve to secure a pool liner in place when a retainer bead is installed in a channel or groove below aforementioned channel. This device is limited to in-ground pools and requires that the swimming pool coping be embedded in a poured concrete deck which surrounds the top of the pool, therefore posing a problem for existing concrete pools absent such embedded coping.

U.S. Pat. No. 4,092,809, issued in the name of Bellas et al., discloses domed roof structures consisting of a frame and covering to enclose or cover above and in-ground swimming pools, garages, greenhouses, patios, sheds, and the like. The domed roof structure consists of a domeplate occupying the top of the domed roof structure, the interlocking rafter-sections which connect to and extend from the domeplate to the base into which the rafters are locked, the ridge-plate and ridge-sections, and the cover, consisting of a lightweight durable material such as nylon, vinyl, etc. The domeplate, which covers a wide variety of shapes for enclosure such as circular, regular polygonal, and oval, interlocks with the upper ends of a plurality of rib sections. The rib sections extend in a downward arc to the base of the structure where their ends interlock with base or seat plates that border the area to be covered by the structure. A seat plate is held down by an U-shaped buckle for above ground swimming pools, whereas an eye-bolt is used with in-ground swimming pools. The eye-bolt is molded to the back of the seat plate and is secured by a rope, thereby providing a tight fit against windy conditions. This device discloses numerous shapes utilizing modified rib sections and dome plates. An A-frame dome plate is an example. However, to ensure the structure is interlocking, it utilizes tenons and spring loaded bolts instead of screws and nails in conjunction with standard mending plates, angle plates, and T-strap plates. Furthermore, this device utilizes an U-shaped buckle or an eye-bolt to immobilize the roof structure rather than casters with brakes.

U.S. Pat. No. 4,000,527, issued in the name of Gannon, discloses a swimming pool cover support frame consisting of a plurality of individual elongated floating tubular bladders. Inflation of such floating bladders accomplished preferably with the valve of the type permitting mouth inflation. The tubular bladder, when inflated, provides a tapered shape of decreasing diameter from the center of the framework toward the edge of the pool. The plurality of individual tubular bladders are tied together by way of a string or other appropriate fastening means laced through eyelets that are provided at the end of each individual tubular bladder, such as to form the floating frame. The floating frame is attached to the edge of the pool via passing a string through the eyelet of each individual bladder to a ring at the edge of the pool. The pool cover is then placed on top of the floating frame and properly attached to the edge of the pool, thereby yielding an appropriate slope from the center of the cover allowing rain and debris to run off. Because the device consists of inflatable tubes, it is subject to puncture, structural integrity failure, or deflation and therefore provides a limited margin of safety, durability, and overall effectiveness for rain and debris runoff.

U.S. Pat. No. 3,855,643, issued in the name of Sanford, discloses a swimming pool cover arrangement consisting of a skeleton frame mounted over a swimming pool and a flexible sheet material such as plastic to cover the frame. The frame comprises a longitudinally extending member or ridge pole and a plurality of rafters which laterally extend at the sides of the ridge pole. The rafters, consisting of pin anchoring devices with holes through which bolts are extended into, are attached to flanged fittings anchored in the deck which give the frame longitudinal stability. The framework is made up of galvanized steel tubing or pipes. A portion of the cover is not secured to the pool deck so as to allow easy access to and from the pool. Furthermore, by opening the end of the cover, any desired temperature may be provided on the inside yielding environmental control. This apparatus is for in-ground swimming pools only. In addition, the apparatus is unnecessarily complicated in the sense that its removal requires unhooking fittings, elastic cords, and anchoring devices, and removing bolts from pins, as compared to the present invention which utilizes wheels making it easy to move, store, and setup.

U.S. Pat. No. 3,534,412, issued in the name of Crook, discloses a cover support structure consisting of a center support member fabricated from lengths of thin wall metal pipe such as iron, steel, or aluminum, but a preferred material is plastic pipe, namely one made from polyvinyl chloride plastic compound. These center support pipe sections are joined by means of a four-way coupling and are supported by a plurality of individual side support pipe sections. The couplings are removably attached by pins inserted in openings provided on the four-way coupling. The support structure is adaptable for in-ground pools providing a coping or which have a substantially right angle merger of the sidewall with the pool walk. When the pool is provided with a coping, the side support pipe sections are removably attached to the pool by means of an anchor assembly. This anchor assembly includes a center upturned finger and two down turned fingers which grip the coping on the pool. The side support sections are inserted over the upturned fingers. When the sidewall of the pool and the walk area are joined at the upper end of the sidewall, the anchor assembly is constructed from round metal stock providing diverging fingers with straight down turned ends. Such ends should make about a ninety-degree angle with the straight portion of the fingers in order to conform to the shape of the pool's upper edge. Each down turned end provides a boot made of rubber or other plastic type of material bonded to the ends of the fingers. Such a boot prevents the down turned fingers from slipping on the sidewall of the pool. Two other embodiments for the anchor assembly may be utilized in the present invention. The first consists of bending a rod into a U-shape whereby the base portion of the U rests on the walk and the down turned ends rest against the sidewall of the pool. An upwardly projecting arm receives the lower end of a side support pipe section. The second embodiment consists of bending a rod into a V-shape with a base portion and two down turned ends. This embodiment utilizes a pivoting arm supported by a bolt being welded to the base portion of the V. The side support pipe sections are slipped there over. The cover support structure is covered by a flexible pool cover constructed from a suitable water and weatherproof material such as treated canvas. The pool cover, being larger than the support structure, is spread over such structure and extends out over the walk area. The pool cover is held in place by means of weighted bags. However, if desired, the edges of the pool cover may be provided with eyes and the pool cover can be tied to ground anchors. Alternatively, the pool cover can be anchored into recessed eye rings provided in the walk area.

This device is limited to in-ground pools and requires an anchor assembly utilizing either the coping of a pool, diverging fingers, or a pivoting arm, as compared to the present invention which utilizes casters with brakes as its anchoring means.

U.S. Pat. No. 5,426,899, issued in the name of Jones, discloses a swimming pool cover for enclosing a pool or similar rectangular space. The frame assembly of the pool cover consists of a plurality of opposed side and end support brackets arranged in pairs which are mounted along the periphery of the pool. Such support brackets are generally formed from a resilient metal such as aluminum. The support brackets on the first side of the enclosure are of uniform height, and the support brackets on the second or opposite side of the enclosure have a uniform height greater than the height of the brackets on said first side. Each leg member of each side support bracket assembly and end bracket assembly may be constructed with a telescoping section. This type of construction would allow each of the leg members to be telescoped upwardly or downwardly, hence allowing the cover to be elevated as desired. Support cables extend across the pool being supported by the support brackets. A plurality of elongated T-shaped track members are mounted on and supported by the support cables. The track members are generally formed from an extruded plastic material and are configured to receive and hold cover panels. The cover panels are generally formed of a durable flexible weather tight plastic such as polycarbonate sheeting. The cover panel consists of top, end, and corner cover panels. The top and end cover panels are substantially rectangularly-shaped sheets while each corner cover panel is a substantially triangularly-shaped sheet. The cover panel assembly is connected in series by the track assembly in order to cover the top, sides, and ends of the pool. The swimming pool cover is anchored by bolting or spiking each base member of the side-support bracket assemblies and end bracket assemblies to the foundation or into the soil surrounding the pool. If there is no foundation or if the pool cover is to be used as a tent or shelter, a strap is placed across each base member and elongated spikes are inserted through openings in the straps on both sides of the base members to secure such base members in position. This device utilizes cover panels held by T-shaped track members to cover its frame assembly and such frame assembly, being constructed generally of aluminum, is constructed so as to have a downward slope from one side to the other. This is unlike the present invention which has an A-frame like structure consisting of wood.

U.S. Pat. No. 4,683,686, issued in the name of Ozdemir, discloses a removable enclosure cover for a swimming pool area. The enclosure includes a plurality of flexible frame members of rectangular, opaque, transparent, and flexible panel sections with a flexible material such as canvas extending between such frame members. A pair of spaced parallel channel-shaped track members are embedded in the concrete walkway surface and extend along such surface down the sides of the pool. A guide means with at least one pair of rollers extends into the interior of the track members. One roller rolls along the bottom of the track members and is mounted on a vertically movable carriage which allows the frame members to be guided along the track members toward and away from one another to cover and uncover the area between the track members. A locking means is provided which includes a selectively movable clamping member that engages the associated track member in order to prevent movement between the guide means and track members. This device requires that track members be either embedded in the concrete walkway surface or in the case of existing pool structures, to be mounted on the top surface of the pool deck, as compared to the present invention which utilizes casters with brakes as its anchoring means.

U.S. Pat. No. 4,051,638, issued in the name of Heintz, discloses an enclosure for a swimming pool or the like consisting of a cover and a frame. The frame includes a plurality of longitudinally spaced laterally extending ribs which arch over the area to be enclosed. Said ribs consist of a plurality of straight elements that are connected end to end by angularly shaped tubular sections and have their ends received and secured in the ground in vertical sockets. The tubular sections are secured by fasteners. The frame of this enclosure may be enlarged or reduced in size as desired by simply adding or subtracting ribs. The cover, preferably of a flexible plastic material, extends over the top of the frame. A pair of gripper boards or strips having tongue and groove formations are utilized to anchor the cover at the perimeter of the enclosure. This device utilizes some other material rather than wood for the construction of its frame; furthermore, the device utilizes ground sockets as its anchoring means unlike the present invention which utilizes casters with brakes as its anchoring means.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved, modular, wooden, pool cover frame that is designed to support a pool cover.

Briefly described according to one embodiment of the present invention, a modular, wooden, pool cover frame is disclosed, designed to replace conventional floating supports with a frame that spans the area above the pool, providing rigid support that is not susceptible to the aforementioned problems. The present invention is comprised of an A-frame like wooden structure that covers the entire pool area. The frame is modular in design and has a plurality of wheels on the bottom thereof making it easy to store and set up, even by a single person.

Depending upon the size and shape of the pool, a number of vertically aligned, equally spaced A-frame components are placed spanning across the pool and are connected to one another by multiple support beams. Additional support beams are angled from the A-frame components to the ground in order to provide additional support. With the cover placed over the frame, a tent-like shape results that allows debris and water to run off. Furthermore, the strength of the design is such that it can withstand even the weight of a heavy snowfall.

It is envisioned that the present invention is constructed of a material selected from the group comprised of wood, using standard two-by-fours connected to one another using screws and nails in conjunction with standard mending plates, angle plates and T-strap plates. Standard casters are used for the locking wheel assembly.

It is further envisioned that the present invention be in a kit form so as to be easily obtainable and easy to assemble by any pool owner of common skill and manual ability.

It is another object of the present invention to provide a device that supports a pool cover.

It is another object of the present invention to provide a device that allows debris and water to run off a pool cover.

It is another object of the present invention to provide a device that does not need adjustment once in position.

It is another object of the present invention to provide a device that is easy to install, store and move, and which enhances pool cover life while withstanding heavy snowfall.

It is another object of the present invention to provide a device made from wood, thereby giving the present invention high strength, durability, cost effectiveness, and ease of manufacture from readily available materials.

It is another object of the present invention to provide a device that enables the rays of the sun to warm under the pool cover to melt snow fast.

| DESCRIPTIVE KEY | |
|---|---|
| 10 | modular, wooden, pool cover frame |
| 15 | pool cover |
| 20 | A-frame assembly |
| 30 | base beam |
| 40 | slanted support beam |
| 45 | central pillar |
| 50 | apex support beam |
| 60 | apex point |
| 70 | end support beam |
| 80 | locking wheel assembly |
| 90 | center support arm |
| 100 | corner support arm |
| 110 | standard mending plate |
| 120 | angle plates |
| 130 | T-strap plates |
| 140 | base beam support |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a modular, wooden, pool cover frame 10.

The best mode for carrying out the invention is presented in terms of its preferred embodiment, herein depicted within the FIGS. 1 through 5.

1. Detailed Description of the Figures

Figure 1:
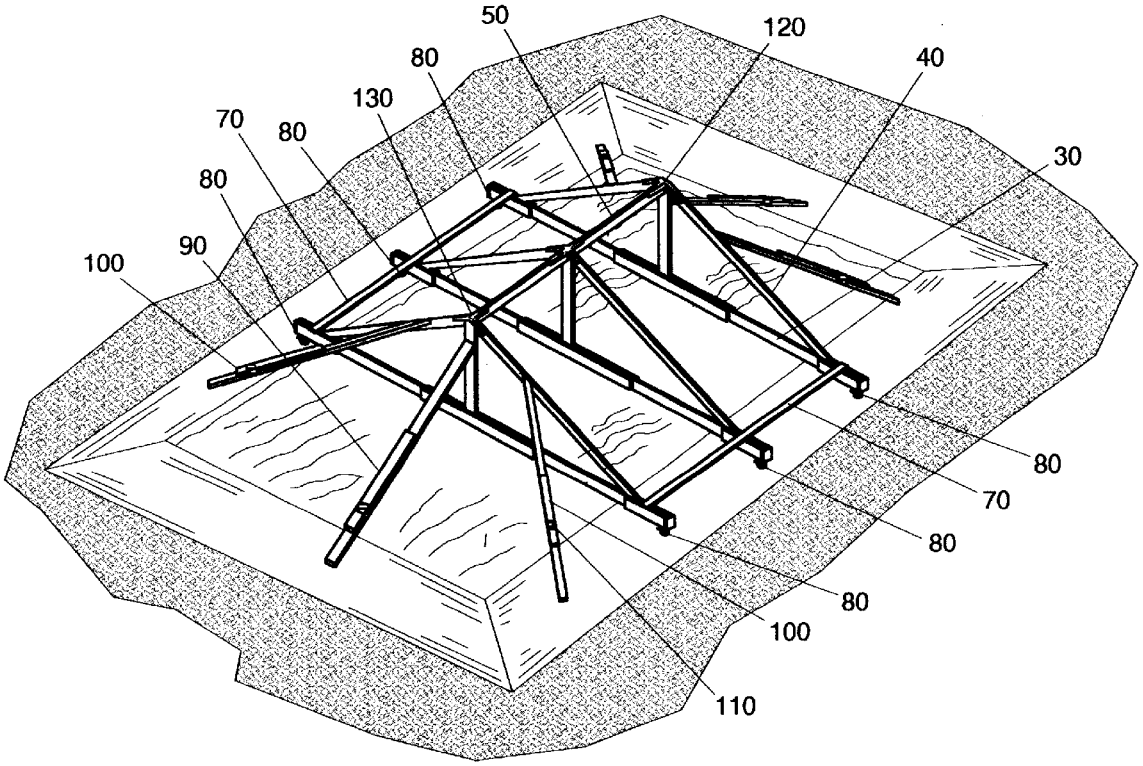
FIG. 1 is an elevational view of a preferred embodiment of modular, wooden, pool cover frame 10.

Referring now to FIG. 1, a modular, wooden, pool cover frame 10 is shown, according to the present invention, designed to replace conventional floating supports with a frame that spans the area above the pool, providing rigid support that is not susceptible to the aforementioned problems. As such, the present invention is designed to be used as a support frame onto which an otherwise conventional pool cover 15 (not shown) is placed.

The present invention is modular in design, comprised of a plurality of laterally elongated, vertically upstanding, A-frame assemblies 20 positioned parallel to one another. Each A-frame assembly 20 is of an upstanding triangular configuration with a laterally elongated base beam 30 two slanted support beams 40 and a centrally located, vertical, central pillar 45. The A-frame assemblies 20 are connected to each other by a plurality of horizontally elongated beams of a generally linearly elongated, rectangular configuration.

Figure 2A:
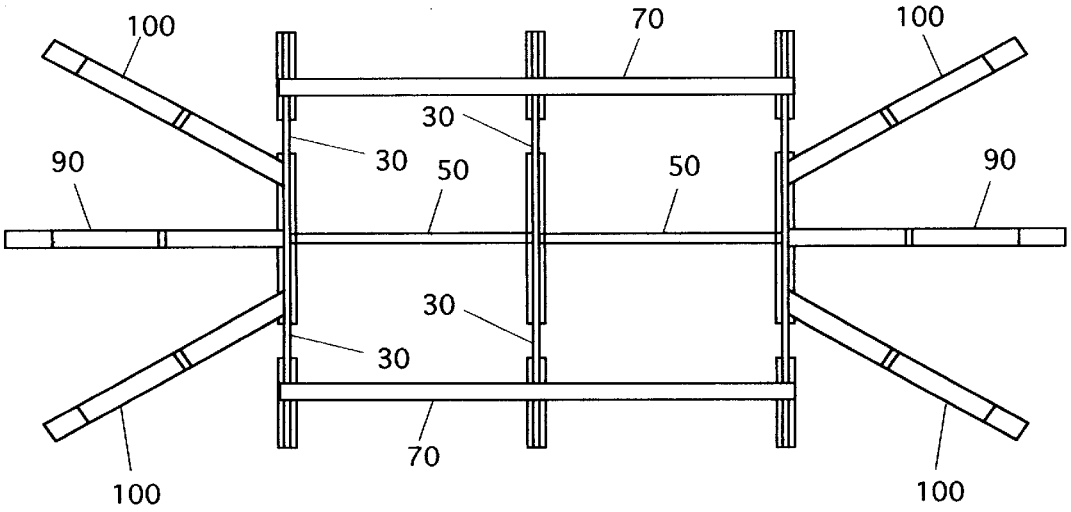
FIG. 2*a* is top view thereof.
Figure 2B:
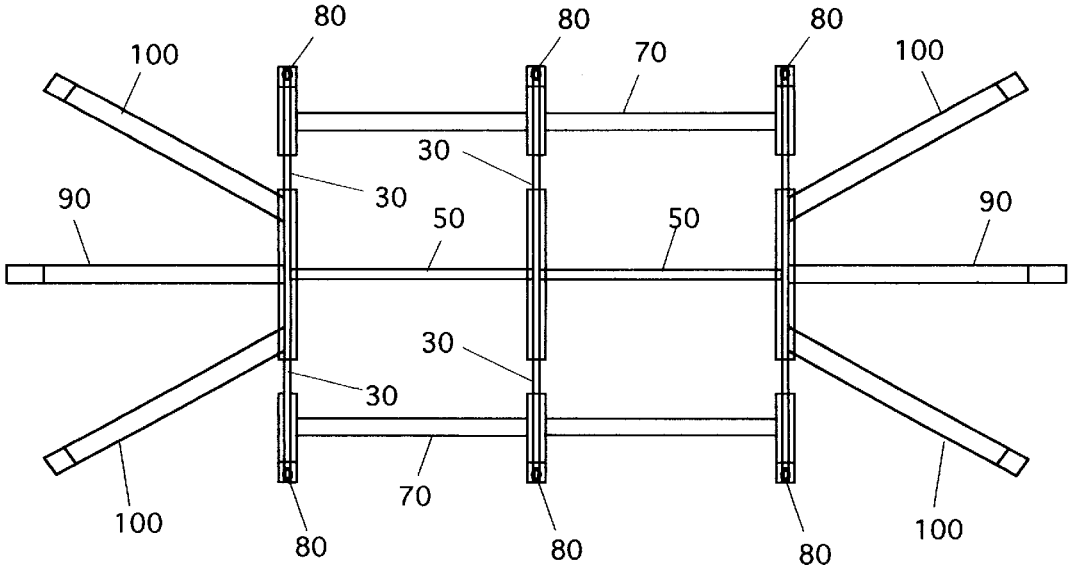
FIG. 2*b* is a bottom view thereof.

Referring to FIGS. 1, 2*a* & 2*b*, the apex support beam 50 connects the apex points 60 of each A-frame assembly 20. An end support beam 70 connects each corner of the respective A-frame assemblies 20 to form a generally rectangular configuration for the present invention.

Figure 3:
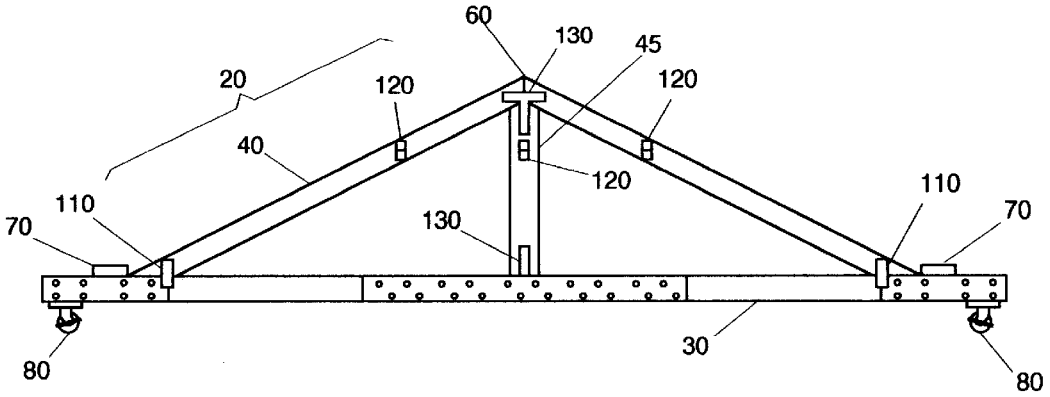
FIG. 3 is a front view of an A-frame assembly.

Referring now to FIGS. 1 & 3, the base beam 30 of each A-frame assembly 20 extends outward laterally beyond the volume of the pool, so as to rest on the surface surrounding the pool. It is envisioned that the base beam 30 is telescopically adjustable, so as to conform to a variety of pool sizes and configurations.

Located at the lateral ends of each base beam 30, on the lower surface of each base beam 30, is a locking wheel assembly 80, comprised of caster wheels which lock. The locking wheel assemblies 80 are designed to permit the present invention to be mobile and adjustable.

Figure 4:
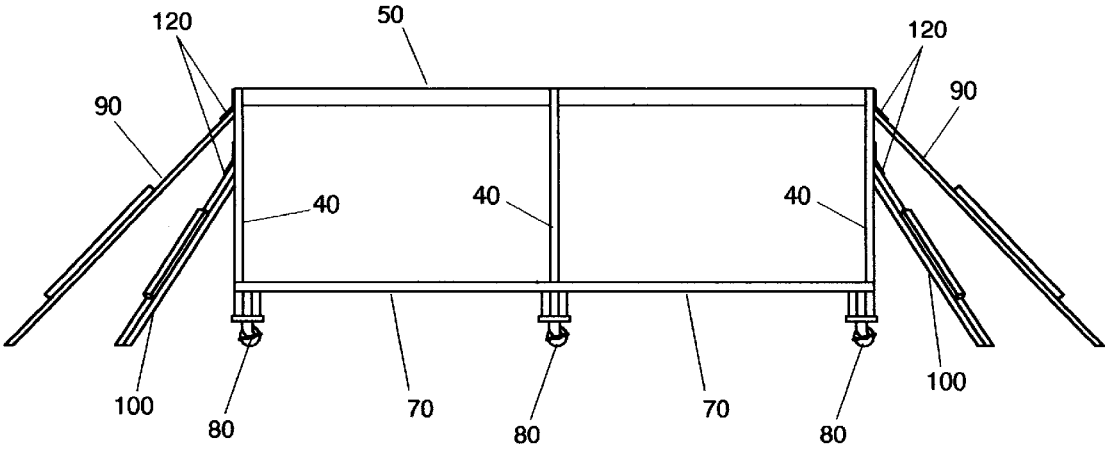
FIG. 4 is a side view of the preferred embodiment of the present invention.

Referring now to FIGS. 1, 2*a* & 4, extending outward and downward from the central pillar of each of the outermost A-frame assemblies 20 is a center support arm 90, of a generally linearly elongated, rectangular configuration. The center support arm 90 extends outward to the surface area surrounding the pool, and is telescopically adjustable. The center support arm 90 is located in the same vertical plane as the apex support beam 50.

Extending outward and downward from the slanted support beams 40 of the outermost A-frame assemblies 20 are a plurality of corner support arms 100, of a generally linearly elongated, rectangular configuration. Each corner support arm 100 extends outward to the surface area surrounding the pool, and is telescopically adjustable. The corner support arms 100 form an angle between 0 and 180 degrees with each other.

It is envisioned that the size, configuration and number of the A-frame assemblies 20, apex support beams 50, end support beams 70, center support arms 90 and corner support arms 100 can be varied to cover pools of varying sizes and configurations.

Figure 5:
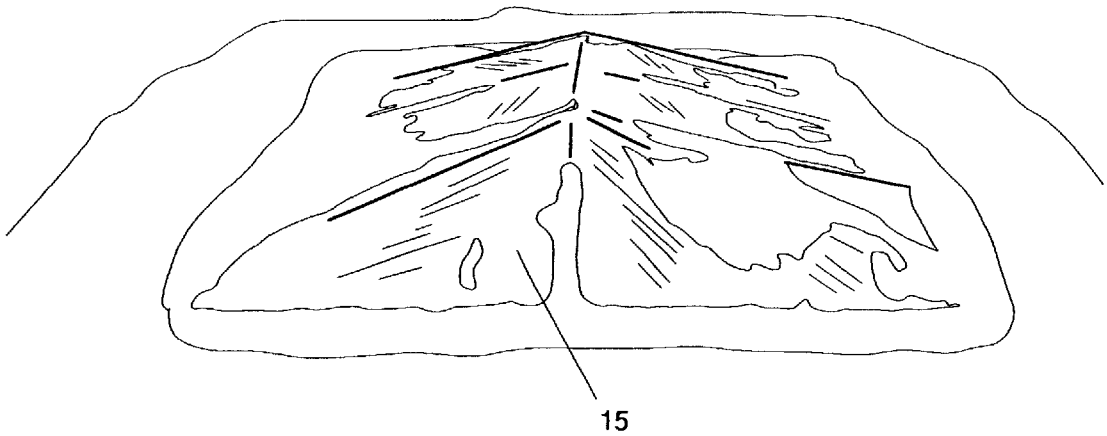
FIG. 5 is a perspective view of the present invention in use.

Referring now to FIG. 5, when assembled, the present invention creates a tent-like structure that covers the entire pool area, and is designed to allow debris and water to run off. Furthermore, the strength of the design is such that it can withstand even the weight of a heavy snowfall.

Referring now to FIGS. 3 & 4, it is envisioned that the present invention is constructed of a material selected from the group comprised of wood, using standard two-by-fours connected to one another using screws and nails in conjunction with standard mending plates 110, angle plates 120 and T-strap plates 130.

Referring now to FIG. 3, a base beam support 140 is used to increase the structural integrity of the A-frame assemblies 20. Each base beam support 140 is of a linearly elongated configuration and is positioned along the central portion of each base beam 30, at the connection points of the wooden members that form each base beam 30.

It is envisioned that alternate embodiments of varying sizes and configurations can be formed from materials selected from a group comprising metal or plastic.

It is further envisioned that the present invention be modular in design, making it simple to assemble and disassemble.

It is further envisioned that the present invention be in a kit form so as to be easily obtainable and easy to assemble by any pool owner of common skill and manual ability. The kit will include three base beams of approximately 18 foot lengths each, two apex support beams 50 of approximately 8 foot lengths each, four end support beams of approximately 8 foot lengths each, two center support arms of approximately 10 foot lengths each, four corner support arms of generally 12 foot lengths each, sixteen screws of dimensions 8½ inches by ½ inch, eight regular wood screws for the apex support beams 50, and six caster wheels with brakes and one Phillips screwdriver or Phillip head bit for a drill.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention: first, assemble the present invention per the instructions, adjusting the size of the various components to correspond to the dimensions of the pool to be covered; second, place the pool cover 15 over the present invention; third, place the present invention over the pool; fourth, lock the locking wheel assemblies 80; fifth, anchor the ends of the pool cover 15 to the surface surrounding the pool.

The foregoing description is included to illustrate the operation of the preferred embodiment and is not meant to limit the scope of the invention. The scope of the invention is to be limited only by the following claims.

What is claimed is:

1. A modular, wooden, pool cover frame, comprising:

a plurality of A-frame assemblies, said A-frame assemblies being of a laterally elongated, vertically upstanding, configuration, positioned parallel to one another, each said A-frame assembly being of an upstanding triangular configuration with a laterally elongated base beam, two slanted support beams and a centrally located, vertical, central pillar; said base beam extending outward laterally beyond the volume of said pool in use, so as to rest on the surface surrounding said pool, and capable of being adjusted lengthwise;

base beam supports, one said base beam support being positioned along the central portion of each base beam, said base beam supports used to increase the structural integrity of said A-frame assemblies;

at least one apex support beam, of a linearly elongated, rectangular configuration, said at least one apex support beam connecting the apex points of adjacent A-frame assemblies;

end support beams, of a linearly elongated, rectangular configuration, said end support beams connecting each corner of said respective A-frame assemblies to form a generally rectangular configuration for the frame;

a plurality of locking wheel assemblies, said locking wheel assemblies located at the lateral ends of each base beam, on the lower surface of each base beam, said locking wheel assemblies designed to permit the frame to be mobile;

center arm supports, of a generally linearly elongated, rectangular configuration, said center arm supports, in use, extending outward and downward from said central pillar of each outermost A-frame assembly to the surface surrounding said pool, said center arm supports located in the same vertical plane as said at least one apex support beam; and corner support arms, of a generally linearly elongated, rectangular configuration, said corner support arms extending, in use, outward and downward from said slanted support beams of each outermost A-frame assembly to said surface surrounding said pool, said corner support arms forming an angle between 0 and 180 degrees with each other.

2. The modular, wooden, pool cover frame described in claim 1, wherein said base beam, center arm supports and corner support arms are adjustable in length, such that said frame can be conformed to fit a variety of sizes and configurations of pools.

3. The modular, wooden, pool cover frame described in claim 1, wherein when assembled, said frame creates a tent-like structure that covers said entire pool area, and is designed to allow debris and water to run off.

4. The modular, wooden, pool cover frame described in claim 1, wherein the frame is constructed of two-by-fours connected to one another.

5. The modular, wooden, pool cover frame described in claim 1, wherein said frame is a kit.

6. The modular, wooden, pool cover frame described in claim 5, wherein said kit includes three base beams of approximately 18 foot lengths each, two apex support beams of approximately 8 foot lengths each, four end support beams of approximately 8 foot lengths each, two center arm supports of approximately 10 foot lengths each, four corner arm supports of approximately 12 foot lengths each, sixteen screws of dimensions 8½ inches by ½ inch, eight wood screws for said apex support beams, and six caster wheels with brakes and one Phillips screwdriver or Phillip head bit for a drill.

* * * * *